United States Patent [19]

Skubic et al.

[11] Patent Number: 5,046,305

[45] Date of Patent: Sep. 10, 1991

[54] SLEEVER MODULE FOR DISK PACKAGING UNIT

[75] Inventors: Robert L. Skubic, Bloomington; John S. Lee, Coon Rapids, both of Minn.

[73] Assignee: Rimage Corporation, Eden Prairie, Minn.

[21] Appl. No.: 505,929

[22] Filed: Apr. 6, 1990

[51] Int. Cl.[5] ..... B65B 43/22; B65B 43/30

[52] U.S. Cl. ..... 53/572; 53/386.1

[58] Field of Search ..... 53/386, 570, 571, 572, 53/573, 250, 381.6, 386.1, 569

[56] References Cited

U.S. PATENT DOCUMENTS

| | | | |
|---|---|---|---|
| 2,952,954 | 9/1960 | Perrin | 53/571 X |
| 3,468,102 | 9/1969 | Farrar et al. | 53/386 |
| 3,490,195 | 1/1970 | Abramson | 53/386 |
| 3,545,175 | 12/1970 | Lillund | 53/386 |
| 3,594,981 | 7/1971 | Pitts | 53/386 |
| 3,894,905 | 7/1975 | Ehlscheid . | |
| 4,015,515 | 4/1977 | Johnson | 53/386 X |
| 4,064,674 | 12/1977 | Palmer . | |
| 4,149,356 | 4/1979 | Palmer . | |
| 4,300,331 | 11/1981 | Yoshiba . | |
| 4,365,458 | 12/1982 | Palmer et al. . | |
| 4,551,966 | 11/1985 | Aoyagi et al. . | |
| 4,567,715 | 2/1986 | Sawa et al. | 53/572 |
| 4,646,178 | 2/1987 | Garratt et al. . | |
| 4,685,277 | 8/1987 | Ilsemann . | |
| 4,693,659 | 9/1987 | Burke et al. . | |
| 4,733,856 | 3/1988 | Gunther, Jr. . | |
| 4,748,799 | 6/1988 | Truc et al. | 53/386 X |
| 4,910,675 | 3/1990 | Burns et al. | 364/478 |

*Primary Examiner*—John Sipos
*Assistant Examiner*—Linda B. Johnson
*Attorney, Agent, or Firm*—Paul L. Sjoquist

[57] ABSTRACT

A diskette sleever device having a hopper for supporting a stack of empty sleeves, and a feed mechanism for receiving unsleeved diskettes, wherein the topmost empty sleeve is held in a predetermined position along the diskette transport path, and a pair of oscillatory fingers are engageable into the empty sleeve to open it, and a blower assembly is positioned adjacent the upper side of the sleeve to develop a negative pressure to create a suction force to retain the upper side of the sleeve in an open position while the transport mechanism inserts the diskette into the open sleeve.

11 Claims, 3 Drawing Sheets

SLEEVER MODULE FOR DISK PACKAGING UNIT

BACKGROUND OF THE INVENTION

The present invention relates generally to a system for assisting in the recording, checking and packaging process for magnetic diskettes, which have become popularly known as "floppy disks." These diskettes are typically comprised of a flat plastic substrate coated with magnetic particles, most commonly available in the diameter size of 3-½ and 5-¼ inches. The smaller size diskette is typically totally enclosed within a hard, plastic outer shell, with a movable shutter for accessing the magnetic media. In the case of the larger diskette, it is held within a protective paper outer cover, wherein the cover has a radially-extending slot opening, for purposes of magnetically recording and reading information from the surface of the diskette. For purposes of this invention the term "diskette" should be construed to include, in the case of larger diskettes, not only the magnetically-recorded flat plastic substrate, but also the protective cover into which the magnetic substrate is inserted.

The invention particularly relates to an apparatus which typically forms a part of the aforementioned system, to accomplish one of the required steps in the recording and packaging of diskettes. The apparatus receives a prerecorded diskette, inserts the diskette into an envelope or sleeve, and deposits the diskette and sleeve into an appropriate output bin. The invention relates particularly to a system disclosed in U.S. Pat. No. 4,910,675, issued Mar. 20, 1990, and owned by the assignee of the present invention. The invention is an improvement over the sleever module disclosed in the aforementioned patent, and addresses certain problems not contemplated in the patent.

A feature and advantage of the present invention is to provide a diskette sleever module which automatically and sequentially transfers diskettes into a sleever device holding a plurality of empty sleeves, wherein the topmost empty sleeve is opened by the device to receive the transported diskette.

A further advantage and feature of the present invention is to provide an improved mechanism for ensuring that empty sleeves are fully opened to provide an entry for receiving diskettes.

The present invention may be incorporated into the system disclosed in the aforementioned patent, to provide an improved system for recording, checking and packaging magnetic diskettes.

SUMMARY OF THE INVENTION

The sleever apparatus of the present invention includes a transport mechanism for transporting diskettes into a sleever area, the sleever area including a hopper for supporting a plurality of empty sleeves in a stack, the sleeves being aligned with their respective openings facing toward the diskette transport mechanism. A sleever assembly includes one or more air blowers which develop a negative pressure against the topmost sleeve to lift the top sleeve side into an open position, and a mechanical finger which inserts into the topmost empty sleeve and lifts the corners of the opened sleeve upwardly, while the transport mechanism feeds a diskette into the opening. After the diskette has been inserted into the sleeve the sleeved diskette is ejected from the sleever area into a collection hopper. Motion of the diskettes and sleeves are controlled by drive rollers which are coupled via drive belts to one or more motor assemblies. The motor assemblies may be controlled by a central processor, to coordinate the operation of the sleever module with the other components of the overall system.

It is the principal object of the present invention to provide an improved sleever module for receiving and packaging diskettes in a sequential and automatic fashion.

It is another object of the present invention to provide a sleever module having improved mechanism facility for opening sleeves for receiving diskettes.

The foregoing and other objects and advantages of the invention will become apparent from the following specification and claims and with reference to the drawings.

DESCRIPTION OF THE PREFERRED EMBODIMENT

Figure 2:
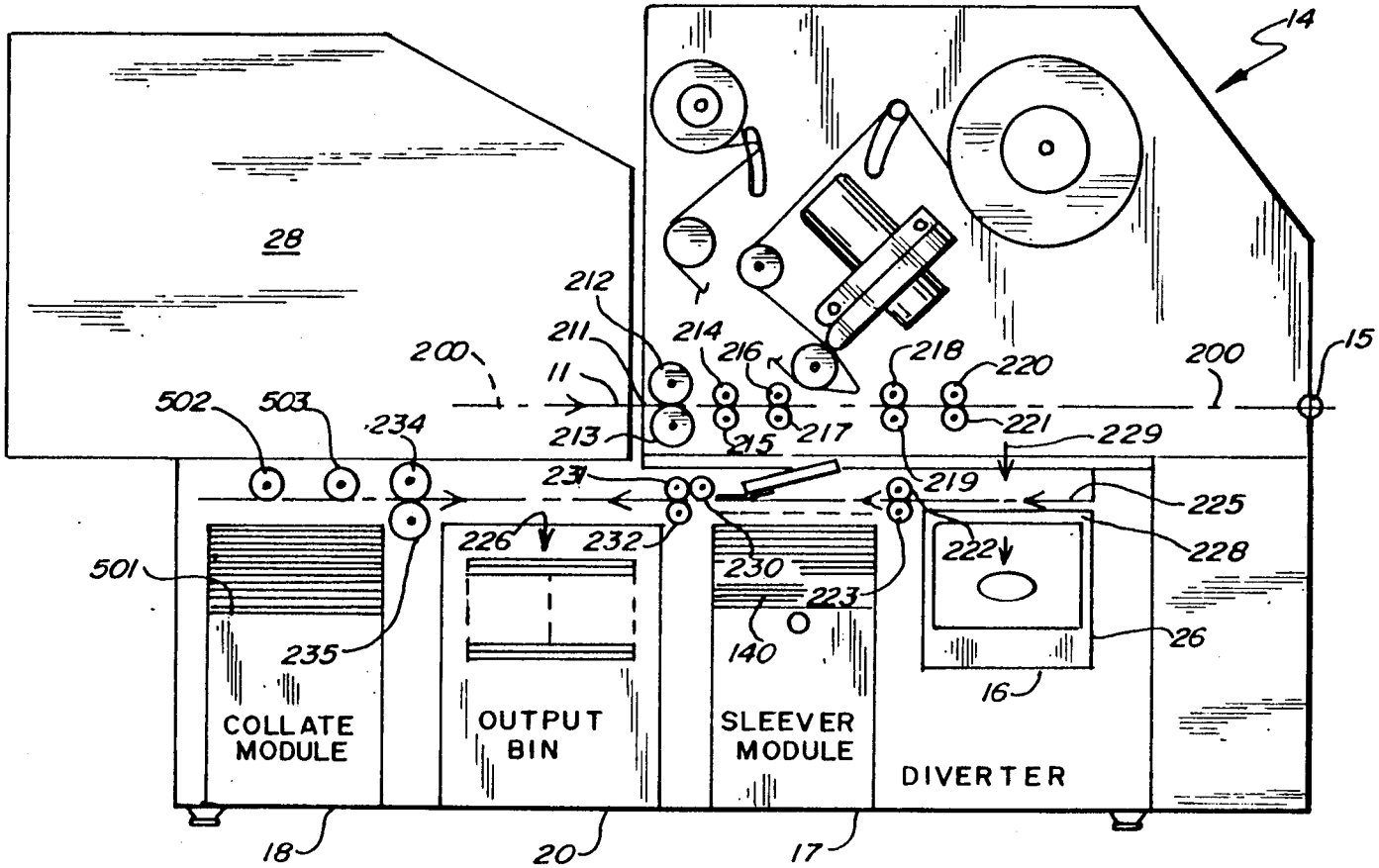
FIG. 2 shows a diagrammatic view of the entire system.

Referring first to FIG. 2, there is shown a diagrammatic elevation view of the invention and associated equipment comprising a system for recording, checking and packaging magnetic diskettes. A duplicator 28 performs the actual magnetic recording functions, applying the desired magnetic data recording to the magnetic media of a diskette. After recording, the duplicator 28 ejects the prerecorded diskette along axis 200 through an output window 11, and into a labeler/printer subsystem 14. The diskettes enter the subsystem through an input window 211, and are conveyed along axis 200 in a direction generally shown by the arrows, by means of drive rollers 212–221. A printed label is applied to the prerecorded diskettes during the transport through the labeler/printer subsystem 14.

The prerecorded and labeled diskette is then ejected downwardly in the direction of arrow 229 through an open chute into diverter module 16. Diverter module 16 has an openable gate 228, which may be opened to divert the diskettes toward reject chute 26, or maintained in a closed position to permit drive rollers 222 and 223 to convey the diskettes leftwardly along axis 225 in the direction of the arrows.

Figure 1:
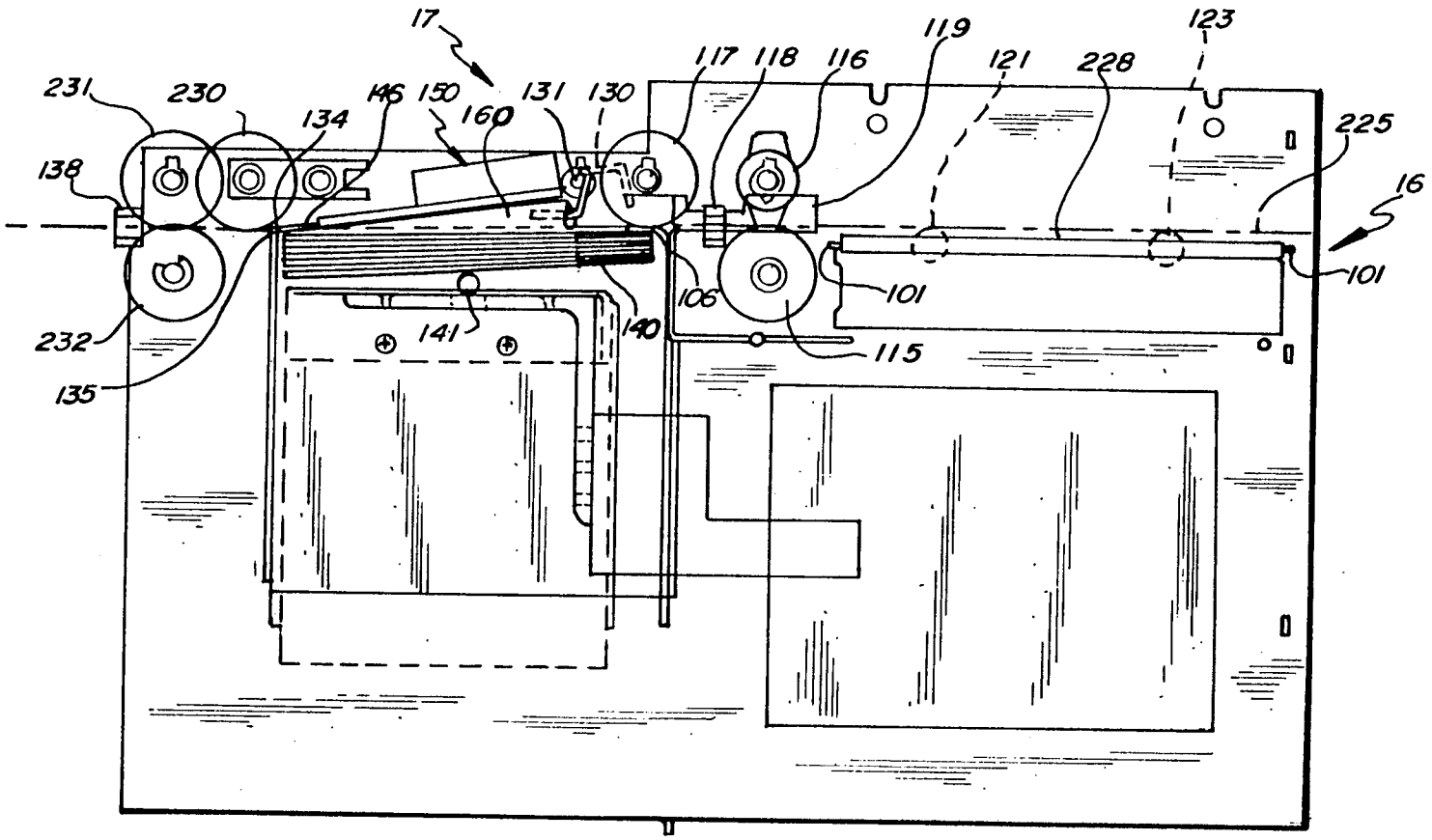
FIG. 1 shows a front elevation view of the sleever module and transport mechanism.

The diskettes which are conveyed leftwardly along axis 225 enter sleever module 17, wherein the diskettes are inserted into an envelope or a sleeve. A plurality of envelopes or sleeves are arranged in a vertical stack 140. Sleever module 17, to be described in greater detail hereinafter, inserts the diskettes into the envelope or sleeve and conveys them along axis 225 by drive rollers 230–232, toward an output bin 20. The sleeved diskettes are permitted to fall downwardly into output bin 20 under the force of gravity, as shown by arrow 226. Periodically, a separator card or sheet may be conveyed by drive rollers 234, 235 rightwardly along axis 225 toward output bin 20, from a collate module 18, to become inserted between predetermined groups of the collected diskettes. A plurality of separator cards are arranged in a vertical stack 501 in collate module 18, and are conveyed rightwardly by drive rollers 502 and 503. Referring next to FIG. 1, an elevational view of diverter 16 and sleever module 17 is shown, with the outside front housing removed. Axis 225 illustrates the plane of travel of the diskettes through diverter 16 and sleever module 17. The openable gate 228 receives diskettes which are dropped downwardly from above, after transport through the labeler/printer module 14. Gate 228 is pivotally hinged about hinge pins 101, to support its top surface closely adjacent to axis 225. In this position, gate 228 is a platform for receiving diskettes dropped from above, and permits the diskettes to be conveyed leftwardly along axis 225 into the sleever module 17. Rollers 120–123 project through openings in gate 228, and are continuously rotated by a drive connection to motor 301 (see FIG. 3) to provide the leftward transport force along axis 225.

The transported diskettes are received between rollers 115 and half rollers 116; rollers 115 rotate in a counterclockwise direction as viewed in FIG. 1, and half rollers 116 rotate in a clockwise direction. Rollers 116 intermittently come into circumferential contact with rollers 115, during that portion of their rotation when the elongated faces of the rollers are pointed vertically. During the remainder of their rotation cycle, rollers 116 are spaced away from rollers 115, thereby intermittently releasing the leftward forces against the diskettes, and enabling the diskettes to be guided laterally by guide rails 119. Guide rails 119 are positioned on either side of the path of travel of the diskette along the axis 225, to guide the diskettes properly into sleever module 17. A diskette which is transported into the opening between rollers 115 and 116, will become contacted by rollers 116 during a portion of its rotational cycle, and rollers 116 will provide an impulsive leftward force against the diskette, thereby forcing the diskette into the sleever module 17. In entering the sleever module 17, the diskette passes through an optical sensor 118 which detects the presence of the diskette at the entrance to the sleever module 17.

A diskette entering sleever module 17 is propagated leftwardly by drive roller pair 117. The diskette is propelled into a sleeve which is held in an open position by the operation of sleever fingers 130 and blower assembly 150. Air blowers contained within blower assembly 150 are activated, creating a negative pressure beneath assembly 150 and above the top surface of sleeve 160. This negative pressure causes a suction to hold the top surface of sleeve 160 against the lower surface of the blower assembly 150, thereby creating a sizable opening for insertion of sleeve fingers 130. Sleever fingers 130 are affixed to an oscillating shaft 131, which shaft 131 is connected to motor 302 by means of a crank linkage. The rotation of motor 302 causes shaft 131 to rotate approximately 110°, to move sleever fingers 130 from a first position as shown in FIG. 1 in solid outline, to a second position shown in FIG. 1 in dotted outline. As the sleever fingers 130 move from their second position to their first position they swing through an arc which causes the fingers to project into the topmost sleeve 160 in stack 140. As the sleever fingers 130 continue their arcuate path of motion, they lift the outer corners of the sleeve 160, raising the sleeve outer corners in an upwardly direction.

The sleeves are retained on a spring-loaded platform within sleever module 17, to form a stack 140, the lower side of the uppermost sleeve being upwardly pressed against a projecting lip 106. The stack 140 is pivotally mounted about pivot 141, and a compression spring (not shown) exerts a gentle upward force against the stack to cause it to remain aligned as shown in FIG. 1. The conventional sleeves used for this purpose have, at their respective open ends, an elongated lower edge and a shortened upper edge, so that the interaction of lip 106 and sleever fingers 130 with the respective edges can be accomplished within sleever module 17.

The insertion of a diskette into a sleeve causes the sleeved diskette to move leftwardly. This leftward movement opens the spring engagement of leaf spring 146, which contacts the upper edge 135 of the rear upper wall at point 134. The force of leaf spring 146 is sufficient to hold the topmost empty sleeve downwardly against stack 140, but when the topmost sleeve becomes filled with a diskette, the filled diskette raises leaf spring 146 upwardly away from contact at point 134. The sleeved diskette is then grasped by a roller 230 and moved leftwardly along axis 225, coming into contact between rollers 231 and 232 for further leftward movement. The sleeved diskette is ejected through an optical sensor 138, and the trailing edge of the sleeved diskette passing through the sensor causes activation of the motor 302, coupled to oscillatory shaft 431, to recycle sleever fingers 130 through their range of motion. In this manner, the next sleeve is opened by blower assembly 150 and sleever fingers 130, to complete the cycle of operation.

Figure 3:
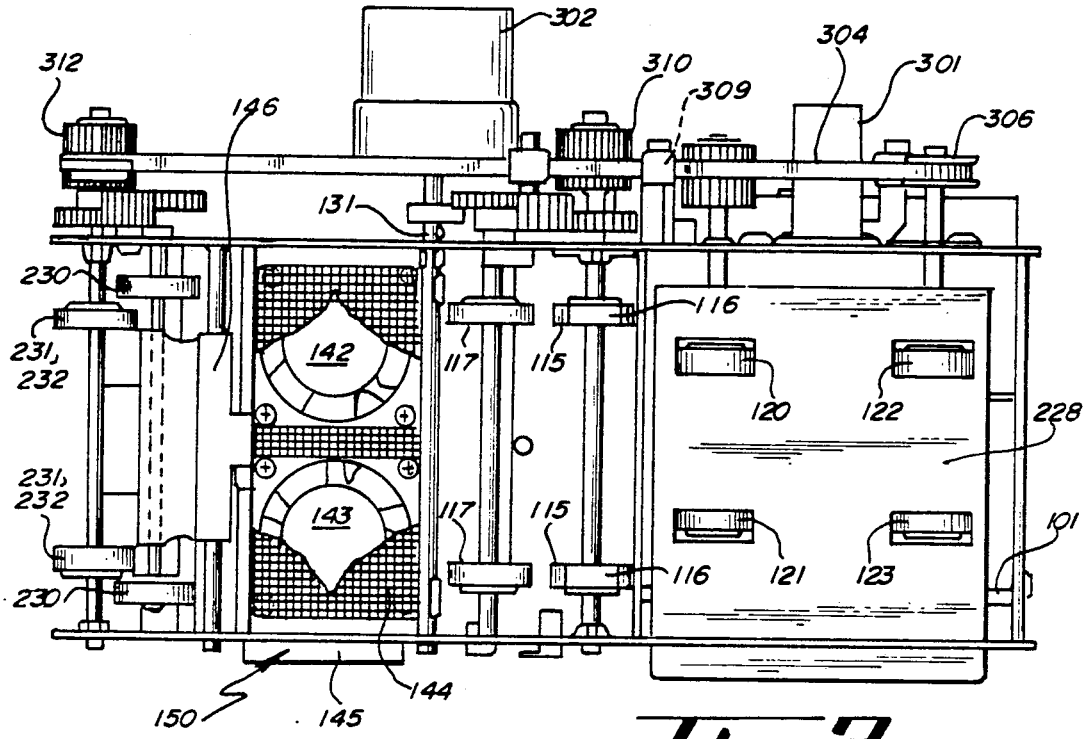
FIG. 3 shows a top view of the apparatus shown in FIG. 1.
Figure 4:
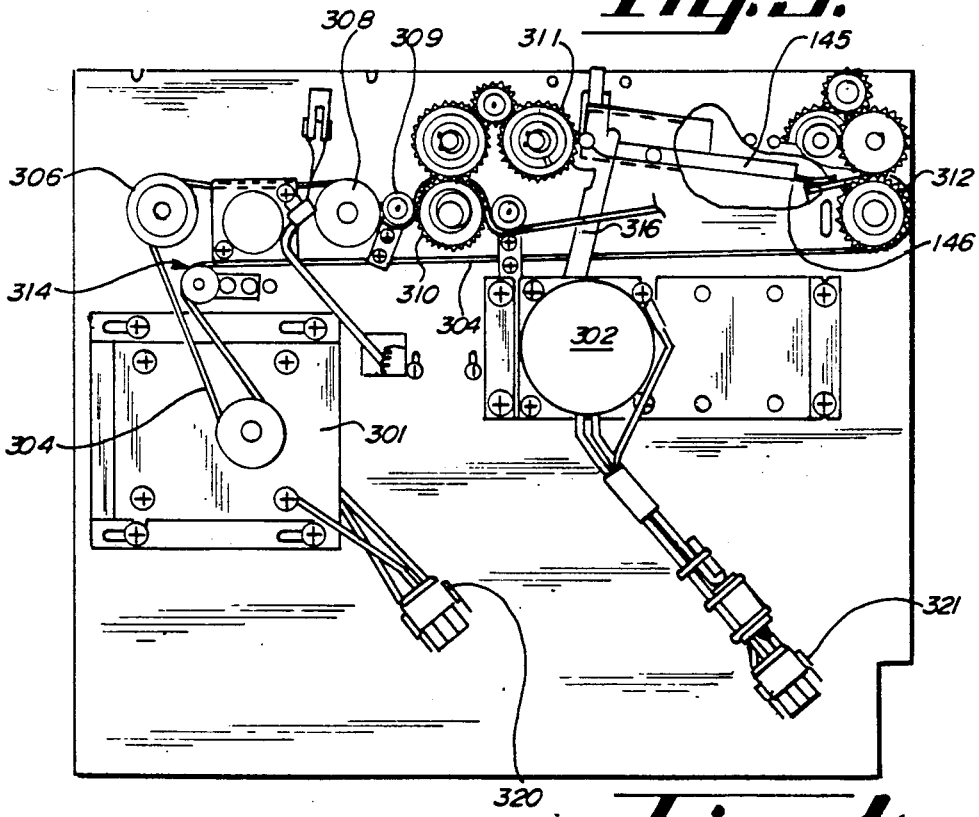
FIG. 4 shows a rear elevation view of the apparatus shown in FIGS. 1 and 3.

The invention is shown in top view in FIG. 3, and in rear elevation view in FIG. 4. FIG. 3 shows the position of blower assembly 150, which in the preferred embodiment utilizes two blower fans 142 and 143, shown in partial cutaway in FIG. 3. A screen 144 is positioned beneath blower fans 142 and 143, and when the fans are actuated an air flow is directed upwardly through the screen 144. The negative pressure caused by this air flow causes the top side of a sleeve to become drawn into contact with screen 144, thereby holding the sleeve in an open position. Screen 144 prevents the sleeves from coming into contact with the blades of the blowers. The type of blower fans which might be utilized for this purpose are commercially available, as for example a blower fan designated as Model No. FL24A306, manufactured by EG&G Rotron, and disclosed in U.S. Pat. No. 4,494,028. Such blower fans are of relatively small size, and develop a sufficient suction force when mounted as disclosed herein.

Blower fans 142 and 143, and screen 144, are mounted on a plate 145 which has an opening therethrough for permitting air flow passage through the screen and fans. Plate 145 is mounted along an incline to provide space for air flow and to raise the top sleeve side away from the bottom sleeve side, thereby to open the sleeve. Leaf spring 146 is attached to the rear edge of plate 145, to exert a downward spring force against the topmost sleeve 160, thereby to keep it properly aligned for passage along axis 225.

Referring to FIGS. 3 and 4, motor 301 drives a belt 304 which is connected to a number of drive pulleys and gear arrangements. Belt 304 is coupled to a drive pulley 306 which is connected to the shaft for rotating rollers 122 and 123. Belt 304 is also connected to drive pulley 308, which is coupled to the same shaft as rollers 120 and 121. Belt 304 is guided beneath idler roller 309, and into driving engagement with gear drive 310. A second idler pulley 311 is positioned adjacent gear drive 310, and belt 304 is next coupled to gear drive 312. After gear drive 312 belt 304 passes over takeup roller 314 and back to motor 301.

Gear drive 310 is coupled via a gear train to shafts for rotating drive roller pairs 115, 116 and 117. Gear drive 312 is coupled to a gear train to drive shafts upon which are connected drive roller pairs 230, 231 and 232.

Motor 302 is coupled to shaft 131 via a crank arm assembly 316. Motor 302 causes the oscillatory motion of sleever fingers 130, as has been described hereinbefore.

Motor 301 may be connected to an appropriate control system (not shown) via connector 320. Likewise, motor 302 may be connected to an appropriate control system through connector 321. Control over the overall system is typically accomplished by a computer processor which receives signals from various components of the system, including optical sensors 118 and 138, to monitor the progress of diskettes and sleeves throughout the system, and to activate the necessary motors and drive solenoids in order to accomplish overall system coordination. In operation, the present invention is controllable by such a computer processor, to transport diskettes into the sleever module 17, to operate the sleever fingers and blower assembly, and to actuate the transport rollers, so as to automatically and sequentially place a plurality of diskettes into sleeves and accumulate the same in an output bin. It is contemplated that the computer processor control will also be capable of detecting, through the various sensors, instances where the transport system breaks down, so as to stop the sequencing of diskettes through the system.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. An apparatus for sequentially inserting flat disk products into an open-ended sleeves, wherein the open end of each sleeve respectively comprises a shorter edge and a longer edge, comprising:

a) a hopper for retaining a stack of said sleeves with said shorter edges up and said longer edges down;

b) a disk conveying means for transporting unsleeved disks along an axis aligned with the topmost sleeve stacked in said hopper;

a stationary air blower assembly positioned above said hopper, said assembly having at least one air blower positioned above and proximate the shorter edges of said stack for directing air flow upwardly away from said stack means for fixedly mounting said assembly along an inclined angle relative to said axis for transporting unsleeved disks with said at least one air blower at the open ed of said angle and the apex of said angle being located closely adjacent said axis for transporting unsleeved disks downstream along the transporting direction; said air blower assembly further comprising a leaf spring affixed at one end proximate the apex of said angle and having a second end facing downstream and biased toward said axis for transporting; and d) means for actuating said at least one air blower, whereby said air flow develops a negative pressure to lift the shorter edge of said topmost sleeve into contact against said air blower assembly.

2. The apparatus of claim 1, further comprising a projecting lip affixed above said hopper, said lip overlapping the longer edge of said topmost sleeve.

3. The apparatus of claim 2, further comprising a rotatable shaft mounted above said hopper, said shaft having affixed thereto at least one finger which is engageable into the open end of said topmost sleeve, and means for rotating said shaft in an oscillatory motion.

4. The apparatus of claim 3, wherein said means for rotating said shaft further comprises means for oscillatory rotating from a first position wherein said at least one finger is engaged into the open end of said topmost sleeve, to a second position wherein said at least one finger is wholly disengaged from said topmost sleeve open end, and back to said first position.

5. The apparatus of claim 1, wherein said air blower assembly further comprises a plate having an enlarged opening therethrough, said at least one air blower being mounted to said plate over said enlarged opening, and a screen affixed to said plate across said opening.

6. The apparatus of claim 5, further comprising a projecting lip affixed aboove said hopper, said lip overlapping the longer edge of said topmost sleeve.

7. The apparatus of claim 6, further comprising a rotatable shaft mounted above said hopper, said shaft having affixed thereto at least one finger which is engageable into the open end of said topmost sleeve, and means for rotating said shaft in an oscillatory motion.

8. The apparatus of claim 7, wherein said means for rotating said shaft further comprises means for oscillatory rotating from a first position wherein said at least one finger is engaged into the open end of said topmost sleeve, to a second position wherein said at least one finger is wholly disengaged from said topmost sleeve open end, and back to said first position.

9. An apparatus for retaining a plurality of open-ended sleeves, each sleeve open end having a lower longer edge and a shorter upper edge, and for opening said sleeves sequentially for receiving a flat disk product therein, comprising:

a) a hopper for retaining a stack of said sleeves, said hopper having means for resiliently biasing said stack in an upward direction;

b) a projecting lip over said hopper, said lip positioned in an overlapping relationship to the longer lower edge of the topmost sleeve in said stack;

c) a stationary blower assembly mounted above said hopper, said blower assembly further comprising an inclined stationary plate having a first end affixed close to said hopper along a side positioned away from said projecting lip, and having a second end inclined upwardly toward said projecting lip, said plate further having an opening therethrough proximate said second end and further comprising at least one blower mounted to said plate over said opening for directing air flow upwardly, thereby creating a negative pressure suction force against the shorter upper edge of the topmost sleeve in said stack; and d) means for transporting a flat disk product into said topmost sleeve.

10. The apparatus of claim 9, further comprising a rotatable shaft mounted above said hopper, said shaft having affixed thereto at least one finger which is engageable into the open end of said topmost sleeve, and means for rotating said shaft in an oscillatory motion.

11. The apparatus of claim 10, wherein said means for rotating said shaft further comprises means for oscillatory rotating from a first position wherein said at least one finger is engaged into the open end of said topmost sleeve, to a second position wherein said at least one finger is wholly disengaged from said topmost sleeve open end, and back to said first position.

* * * * *

UNITED STATES PATENT AND TRADEMARK OFFICE

CERTIFICATE OF CORRECTION

PATENT NO. : 5,046,305

DATED : September 10, 1991

INVENTOR(S) : Robert L. Skubic, John S. Lee

It is certified that error appears in the above-identified patent and that said Letters Patent is hereby corrected as shown below:

In column 4, line 35, "!42" should read -- 142 --.

In claim 1, column 5, line 47, insert -- c) -- before "a stationary"; in claim 1, column 5, line 54, "ed" should be -- end --.

Signed and Sealed this

Twenty-seventh Day of April, 1993

*Attest:*

MICHAEL K. KIRK

*Attesting Officer*

*Acting Commissioner of Patents and Trademarks*